United States Patent [19]

Long et al.

[11] 4,376,239

[45] Mar. 8, 1983

[54] INDUSTRIAL MEMBRANE SWITCH

[75] Inventors: Eric L. Long, Northbrook, Ill.; Gary C. Fillus, South Milwaukee; Kenneth L. Paape, Mequon, both of Wis.

[73] Assignee: Allen-Bradley Company, Milwaukee, Wis.

[21] Appl. No.: 373,669

[22] Filed: Apr. 30, 1982

Related U.S. Application Data

[63] Continuation of Ser. No. 193,470, Oct. 3, 1980, abandoned.

[51] Int. Cl.[3] ..... H01H 13/06; H01H 13/52; H01H 13/70

[52] U.S. Cl. ..... 200/159 B; 200/302; 200/330; 200/340; 200/5 A

[58] Field of Search ..... 200/5 A, 159 B, 296, 200/302, 306, 330, 340

[56] References Cited

U.S. PATENT DOCUMENTS

| | | | |
|---|---|---|---|
| 2,927,988 | 3/1960 | Powell | 200/159 |
| 3,503,031 | 3/1970 | Nyhus et al. | 338/99 |
| 3,539,749 | 11/1970 | MacPheat | 200/159 |
| 3,596,033 | 7/1971 | Wickham | 200/302 |
| 3,627,927 | 12/1971 | Schmitz et al. | 200/159 B UX |
| 3,643,041 | 2/1972 | Jackson | 200/5 A |
| 3,676,615 | 7/1972 | Wiedmer | 200/1 R |
| 3,699,294 | 10/1972 | Sudduth | 200/243 |
| 3,718,791 | 2/1973 | Szablowski | 200/86 R X |
| 3,728,509 | 4/1973 | Shimojo | 200/159 B |
| 3,735,068 | 5/1973 | Yanaga et al. | 200/159 B |
| 3,743,797 | 7/1973 | Hoffman | 200/5 R X |
| 3,770,925 | 11/1973 | Nelson et al. | 200/296 |
| 3,770,926 | 11/1973 | Wanner | 200/291 |
| 3,773,997 | 11/1973 | Evans et al. | 200/159 B |
| 3,773,998 | 11/1973 | Seeger, Jr. et al. | 200/159 B |
| 3,780,237 | 12/1973 | Seeger et al. | 200/159 B |
| 3,806,685 | 4/1974 | Seeger, Jr. et al. | 200/159 B X |
| 3,829,632 | 8/1974 | Klehm | 200/159 B |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,879,586 | 4/1975 | DuRocher et al. | 200/159 B X |
| 3,886,012 | 5/1975 | Slater | 200/5 A X |
| 3,886,335 | 5/1975 | Hendricks | 200/5 R X |
| 3,898,421 | 8/1975 | Suzumura | 200/159 B |
| 3,987,259 | 10/1976 | Larson | 200/5 A |
| 4,018,999 | 4/1977 | Robinson et al. | 200/239 X |
| 4,060,703 | 11/1977 | Everett, Jr. | 200/5 A |
| 4,065,649 | 12/1977 | Carter et al. | 200/5 A |
| 4,088,855 | 5/1978 | Emery | 200/16 A |
| 4,117,438 | 9/1978 | Kim et al. | 336/75 |
| 4,156,802 | 5/1979 | Gilano et al. | 200/5 A |
| 4,158,115 | 6/1979 | Parkinson | 200/5 A |
| 4,207,448 | 6/1980 | Furusawa et al. | 200/159 B |
| 4,262,182 | 4/1981 | Basler et al. | 200/159 B |

*Primary Examiner*—John W. Shepperd
*Attorney, Agent, or Firm*—Quarles & Brady

[57] ABSTRACT

An electrical switch is provided with a switch operator having a resilient pad on its distal end, the operator being mounted for axial movement in an operator housing to actuate contacts deposited in a double spiral pattern on a substrate coupled to the operator housing. The operator tip is moved first to contact the front side of a flexible membrane which is separated from the contacts by a spacer. The operator pad is then moved further to deflect the membrane and close the gap formed between the shorting patch and the switch contacts, the travel of the operator and the action of the pad providing a sensation of feel to the user. The switch is constructed in single units and in arrays.

5 Claims, 7 Drawing Figures

FIG.2
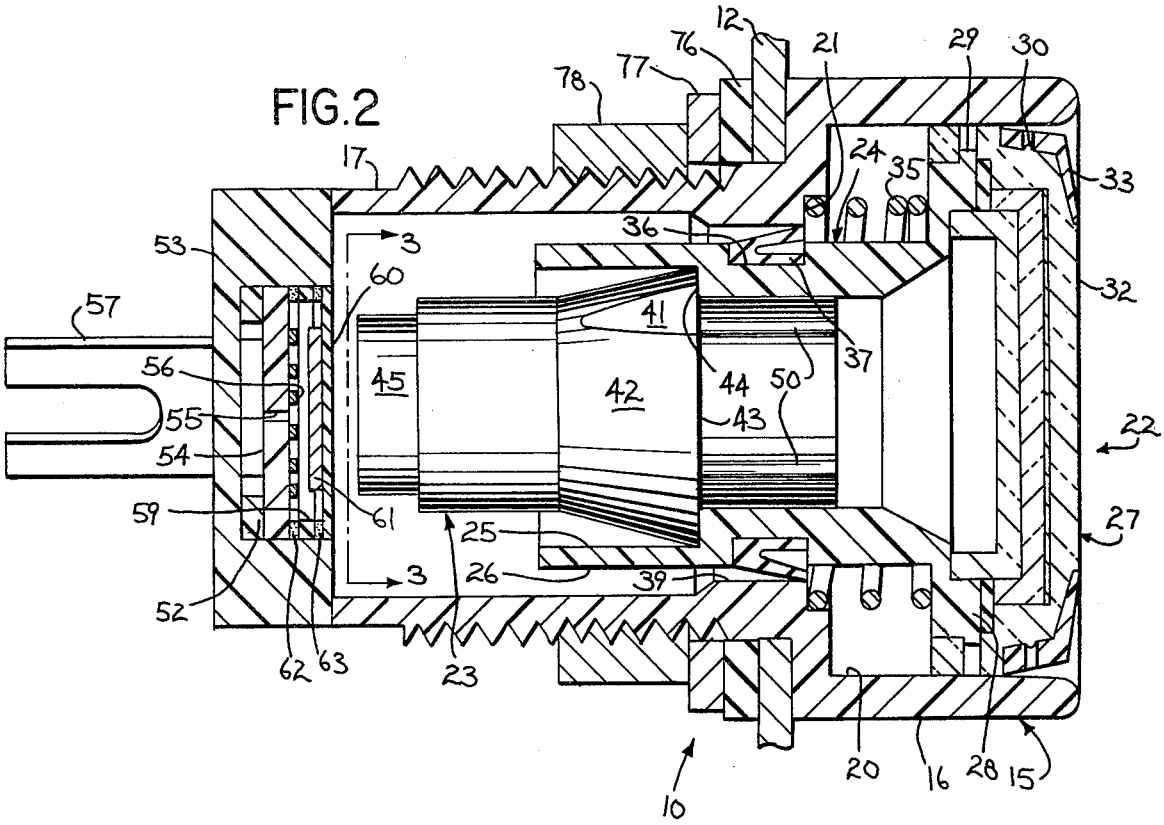
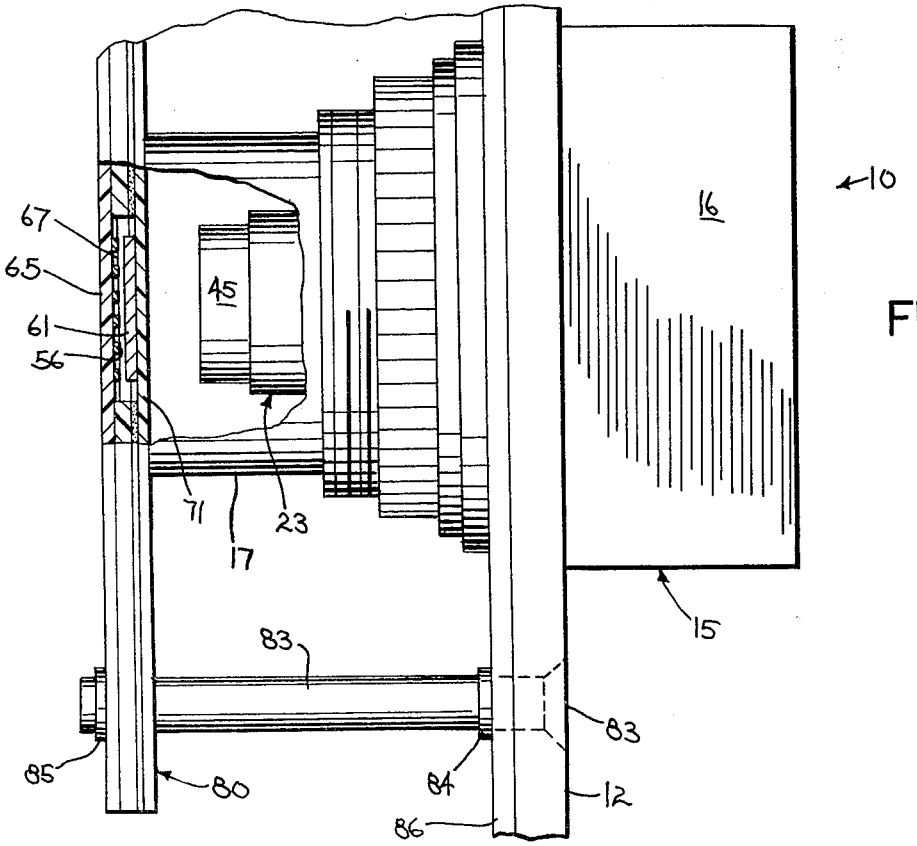
FIG.7

INDUSTRIAL MEMBRANE SWITCH

This is a continuation, of application Ser. No. 193,470, filed Oct. 3, 1980 now abandoned.

BACKGROUND OF THE INVENTION

1. Field of the Invention

The invention relates to the field of control switches of the type used in control panels and switch stations in an industrial environment.

2. Description of the Prior Art

Industrial control switches are characterized by different kinds of operators. In a push button control such as disclosed in Nelson et al, U.S. Pat. No. 3,770,925 issued Nov. 6, 1973, a momentary operator normally provides switch actuation for a short time. In a selector switch, on the other hand, such as disclosed in Wanner, U.S. Pat. No. 3,770,926, issued Nov. 6, 1973, an operator is maintained in one of several selectable positions for a typically longer period.

From these basic control units, other types have been developed through the addition of a secondary circuit to light the switch operator. A push button, for example, may be either constantly lighted or may be the push-to-test type, wherein the operator is lighted upon the successful actuation of the primary switch contacts.

One particular class of industrial switches with these various types of operators must be rugged, reliable, and sealed against the intrusion of oil and other contaminants in the industrial environment. Prior devices of this type such as disclosed in U.S. Pat. Nos. 3,770,925 and 3,770,926 have relied on mechanical contacts that have been sealed within contact blocks coupled to the switch operators.

With the introduction of solid state, digital control equipment there is a need for improved sealed control switches with low-bounce contacts for switching at d-c logic signal levels such as 5 volts, 15 volts and 30 volts.

In the field of digital office equipment, touch-actuated switching panels have been developed to replace traditional key-operated panels. These newer panels commonly involve several thin sheets of an insulating material such as Mylar. A spacing sheet is used between two other sheets on which conductive areas have been formed by screen printing or other deposition processes. The spacing sheet contains openings to allow the conductive areas on the spaced apart sheets to contact one another when pushed together at the touch of an operator. Such pressure sensitive switching panels have their functional labels arranged in patterns and arrays resembling keyboards, yet such panels are flush with the surface of the control panel or equipment utilizing them. Such panels have the advantage of sealed contacts, but in an industrial environment lack the tactility or other form of feedback to the human operator that is provided by traditional industrial controls. Such membranes, touch-sensitive switching panels are by the nature of their construction more readily adapted to arrays and have not provided suitable individual switches that can be located apart from control panels.

SUMMARY OF THE INVENTION

The invention is provided in an electrical switch that combines an operator assembly, having the look and feel desired in the manufacturing environment, with a contact assembly having a thin-layered construction of the general type seen in membrane switches.

The operator assembly includes an operator housing with a front end, a rear end, and an opening therethrough from a housing entrance at the front end to a housing exit at the rear end. An operator is mounted for movement within the housing, the operator having a distal end with a resilient pad thereon that transmits a fingertip reaction when the pad is used to actuate the switch.

The contact assembly includes a contact support structure which supports a substrate and which is coupled to the operator housing to isolate the contacts from the outside environment. A pair of spaced apart contact termination areas are formed on a front side of the substrate. A flexible membrane is mounted on the substrate with spacing means interposed between the front side of the substrate and the membrane to provide a gap between the contact termination areas on the substrate and a shorting patch disposed on an opposing, back side of the membrane. A pair of switch terminals are electrically connected to respective termination areas on the substrate.

When the switch is not being actuated, the resilient pad of the contact operator is spaced inwardly from the housing exit, and therefore, is also spaced from the membrane forming the top layer of the contact assembly. The tip travels through a distance to the housing exit and is then urged against the membrane until the gap between the shorting pad and the termination areas is closed to actuate the electrical switch. The distance which the operator must be moved before contacting the membrane provides a measure of switch travel that is perceptible to the user, and together with the action of the actuator pad provides a sense of "feel" to the user.

The invention provides an inexpensive contact assembly that is easily sealed against contaminants. It is contemplated that switches of the invention may be located where they will be subjected to the mists of lubricating fluids and coolants commonly used in machine shops, as well as the dust and dirt found in the industrial environment. The contact areas on the substrate and the shorting patch on the membrane also provide a low profile contact assembly. The low profile of the contact assembly reduces the overall profile of the switch, which increases flexibility in mounting the switch in confined areas. When the switches of the present invention are mounted on a control panel or other supporting structure, however, they have sufficient profile to be clearly observed. The contacts themselves are less expensive to manufacture than mechanical contacts of the prior art and are easily replaced if accidentally damaged.

The invented switch construction provides individual membrane switch units not seen in the prior art, and it is also readily adapted to the production of switch arrays arranged in matrices of two-by-four, three-by-three, three-by-four, and four-by-four, as examples. An array is provided by producing the selected number of pairs of contact termination areas on a circuit board and by producing a corresponding number of shorting patches in matching configuration on the membrane.

It is one object of the invention to provide a heavy duty, industrial switch with low-bounce switch contacts that occupy a minium of space and are easily sealed against contaminants in the environment.

It is a further object of the invention to provide such a switch with contacts that are inexpensively manufactured and easily replaced, if necessary.

It is another object of the invention to provide a switch of higher profile than a membrane switch but of lower profile than other prior switches of the type which are assembled in arrays in control panels or other supporting structures.

The foregoing and other objects and advantages of the invention will appear from the following description. In the description reference is made to the accompanying drawings which form a part hereof, and in which there is shown by way of illustration two embodiments of the invention. Such embodiments do not necessarily represent the full scope of the invention, however, and reference is made to the claims for determining this scope.

BRIEF DESCRIPTION OF THE DRAWINGS

FIG. 2 is a sectional view of the push button switch of FIG. 1 looking vertically downward through a horizontal plane that bisects the switch, with certain interior parts being broken away;

FIG. 7 is a side view in elevation showing a switch in the assembled array of FIG. 6, with parts broken away.

DESCRIPTION OF THE PREFERRED EMBODIMENTS

Figure 1:
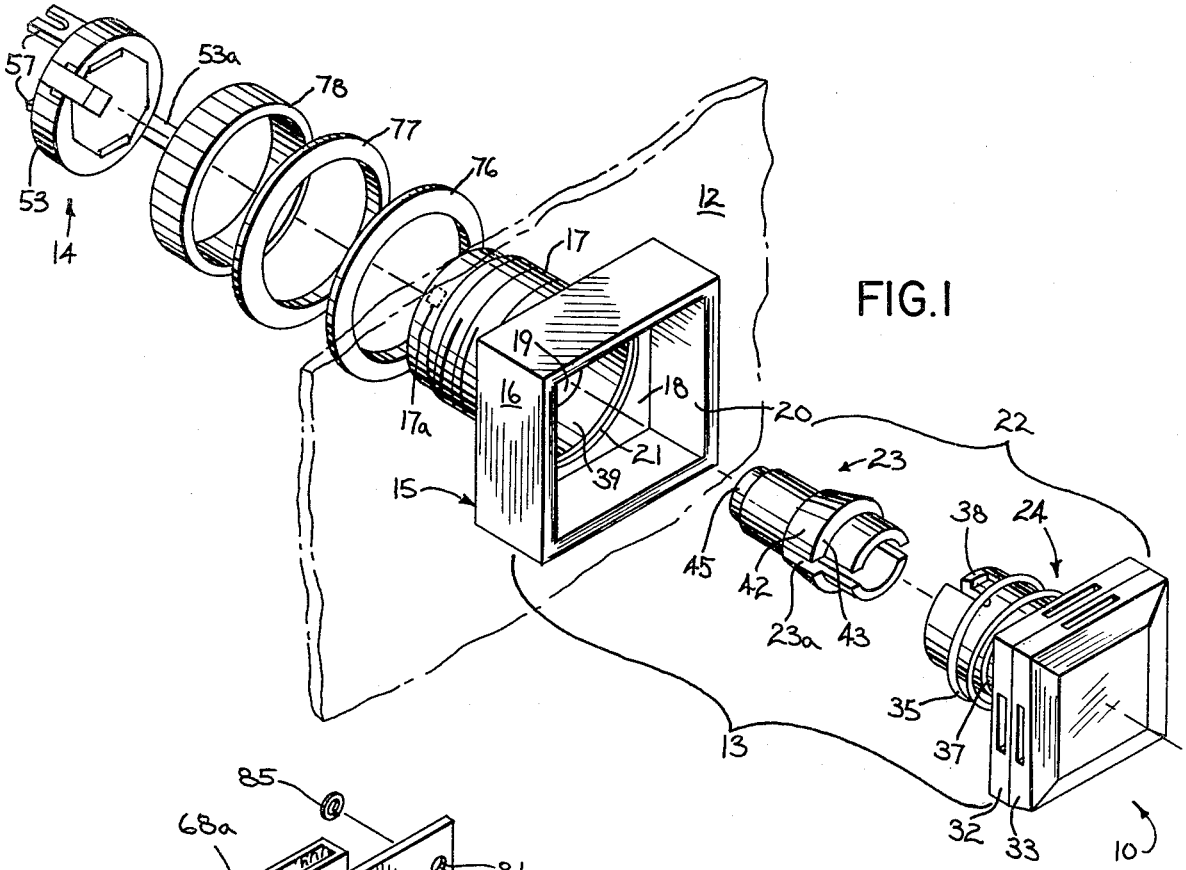
FIG. 1 is an exploded perspective view of a push button switch that embodies the present invention.

Referring to FIGS. 1 and 2, an electrical switch 10 adapted for attachment to a control panel 12 or other supporting structure, includes an operator assembly 13 and a contact assembly 14. The operator assembly 13 is housed in a bezel 15 molded from a thermoplastic insulating material and having a forward box-shaped portion 16 with an entrance into a rectangular opening 20, which is framed by four rounded edge surfaces. A barrel portion 17 of the bezel 15 extends from a rear wall 18 of the rectangular portion 16, the barrel portion 17 having a cylindrical opening 19 that extends from the rectangular opening 20 to a housing exit at the rear end of the bezel 15. An annular spring seat 21 is formed in the rear wall 18 of the rectangular portion 16 around the entrance into the barrel opening 19.

As seen in FIG. 1, an operator 22 includes an elongated, cylindrical plunger 23 which has been removed from a cap assembly 24. Referring to FIG. 2, a plunger-receiving cavity 25 is formed in a hollow, cylindrical cap stem 26 to receive the plunger 23 when the operator 22 is assembled. A complex lens assembly 27 with a plurality of light-transmitting members is mounted on a rectangular flange 28 at the front end of this cap stem 26. The lens assembly 27 forms a head for the operator cap 24 that fills the rectangular opening 20 in the bezel 15 and is flush with the front edges of the bezel 15. The head of the cap 24 could, of course, be positioned rearwardly from the front edges of the bezel 15 to provide a guard for the operator 22. As seen in FIGS. 1 and 2, the lens assembly 27 includes a rectangular lens frame 33 that snap fits over projections 30 formed on the lens 32 and has a rectangular opening in which a portion of the lens 32 is received. The lens 32 in turn snap fits over projections 29 formed on the rectangular flange 28 (as seen in FIG. 2).

When the operator button is assembled in the bezel 15 as seen in FIG. 2, a return spring 35 is captured between the spring seat 21 and the cap stem flange 28. The return spring 35 is compressed when the operator 22 is moved through the opening 19, 20 towards the rear of the bezel 15, and the spring 35 stores energy that exerts a return force on the head of the operator cap 24, when the operator 22 is released by a user. The operator stem 26 has a channel 36 encircling it midway between the stem flange 28 at its forward end and the opening into the plunger cavity 25 at its rear end. A U-cup seal 37 of thin elastomeric material is fitted into this channel, the seal 37 tapering from a wider effective width to a narrower effective width as it extends rearwardly through the barrel opening 19. This seal 37 protects the barrel opening 19 against the intrusion of oil or other contaminants.

Figure 3:
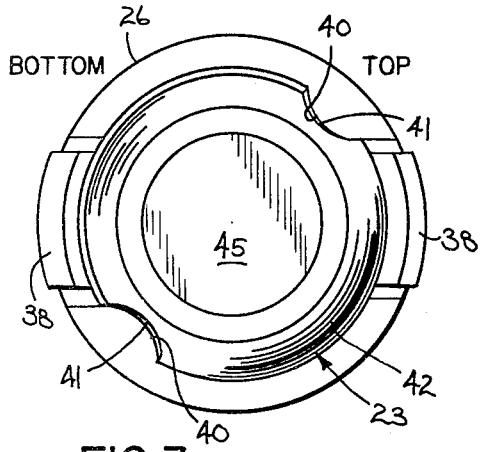
FIG. 3 is a rear end view of the push button operator forming a part of the invention taken in the plane indicated by line 3—3 in FIG. 2.

As seen in FIGS. 1 and 3, the cap stem 26 is formed with two flexible barbed fingers 38, to hold the operator 24 in position within the bezel 15. The barbed fingers 38 are formed by a plurality of slots extending axially into the cap stem 26 from its rear end, the stem 26 being terminated in four segments, two of which form the retaining fingers 38. The barbed ends of these fingers 38 snap over an integrally formed annular retaining ring 39 seen partially in perspective in FIG. 1, and seen in cross section in FIG. 2, where the barrel opening 19 is narrowed at its entrance.

In FIG. 3, two other oppositely disposed segments carry rounded, inwardly extending projections 40 that are radially spaced 180 degrees apart. These projections 40 are received in detents 41 (seen best in FIG. 2) formed in a tapered annular flange 42 seen best in FIG. 1 where it encircles the middle of the plunger 23. The detents 41 are also spaced 180 degrees apart, as seen in FIG. 3, to cooperate in keying the position of the plunger 23 within the stem cavity 25. As seen best in FIG. 1, the beveled flange 42 also forms an annular surface 43 at its forward end, and in FIG. 2 with the plunger 23 inserted in the stem cavity 25, this surface 43 engages an annular stop surface 44 formed in the interior of the cap stem 26. The upper end of the plunger 23 forms ribs 50 that provide an interference fit against the surface defining the upper end of the plunger-receiving cavity 25, to securely hold the plunger 23 against axial displacement relative to the cap stem 26. The plunger 23 is completed by a pad 45 of resilient insulating material which is mounted on its distal end and extends toward the housing exit.

Figure 4:
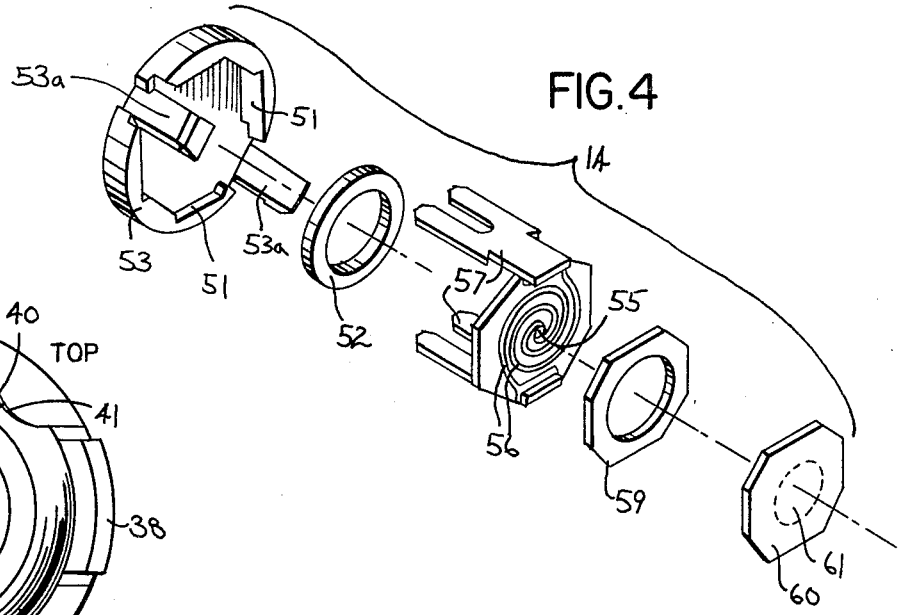
FIG. 4 is a detail exploded view in perspective of a contact assembly that is the upper left component seen in FIG. 1.

Referring to FIG. 4, the contact assembly 14 includes a contact support cup 53 of thermoplastic insulating material with an octagonal cavity that forms eight interior walls. Four rectangular slots 51 are formed in the bottom of the cup and arranged in opposing pairs along orthoganal axes. The slots 51 are each parallel to a respective wall, and these four walls are alternated with four obliquely disposed walls formed around the octagonal cavity. A breather ring 52 of elastomeric material is disposed in the bottom of the cup 53 and an octagonal substrate 54 is disposed over the breather ring 52 as seen in cross section in FIG. 2. The substrate 54 has a centrally located aperture 55 for reasons that are more fully explained in a copending application of Baran et al. filed concurrently herewith and entitled "Industrial Membrane Switch with Breather."

Referring again to FIG. 4, two spiralling termination areas 56 are deposited on the front face of the substrate 54, which is made of an insulating glass-epoxy material with electrolytic copper on one side, using an etching technique of a type well known in the art of making printed circuit boards. The etched circuit pattern is then electroplated with small amounts of nickel and gold. The ends of the spiralling termination areas 56 are electrically connected to the upper ends of a pair of switch terminals 57 which are anchored near the outside edge of the substrate 54 and which are radially spaced 180 degrees apart. These switch terminals 57 have neck-and-shoulder portions connecting their upper ends to two-legged portions. As seen in FIG. 2, the terminals 57 have their neck portions positioned in the slots 51, where their two-legged portions are twisted about the longitudinal axes of the terminals 57, to anchor them in position in the support cup 53.

Referring to FIGS. 2 and 4, an insulating, octagonal, Mylar spacer 59 with a thickness of five mils is adhesively secured to the front face of the substrate 54 between the outside edges of the spiral configuration and the upper ends of the terminals 57, the spacer 59 having a circular aperture in it for access to the contact termination areas 56. On top of the spacer 59 a flat flexible membrane 60 of insulating material is adhesively secured, the membrane 60 in this instance being an octagonal sheet of Mylar with a thickness of five mils and with a circular shorting patch 61 formed on its back side by screen printing or otherwise depositing a dot of conductive ink or paint thereon. With the membrane 60 in position on the spacer 59, as seen in FIG. 2, the shorting patch 61 opposes the contact termination areas 56 but is spaced apart by a gap of approximately twelve mils occupied by the spacer 59 and two layers 62, 63 of adhesive on opposite sides of the spacer 59. The thicknesses of the layers have been exaggerated in FIG. 2 as an aid in disclosing the invention.

Referring to FIGS. 1 and 4, the contact cup 53 has integrally formed, coupling members **53*a* with barbed ends that are received in a pair of rectangular detents 17*a* formed within the interior of barrel 17, one of the detents being seen in phantom in FIG. 1. The barbs extend radially outward with the coupling members being flexed towards one another as they are forced axially into the exit end of the barrel 17. The result of this arrangement is that the contact cup 53 abuts the exit end of the barrel 17, as seen in FIG. 2, to seal the contact elements 56 and 61** within an insulated switch housing.

The resilient pad 45 is spaced from the exit of the barrel 17, so that it moves through a pre-travel distance before engaging the front side of the membrane 60. The pad 45 is then moved through an additional distance to deflect the membrane 60 and bridge the gap between the spiral contact areas 56 using the shorting patch 61 as the bridging contact element. The double spiral configuration of the contact areas 56 eliminates potential blind spots at which deflection of the shorting patch 61 might fail to make a bridging connection; however, this desirable feature is not absolute to the practice of the invention in its broader aspects. When the membrane 60 is deflected, air is circulated through the aperture 55 in the substrate 54 to the void in the middle of the breather ring 52, and when the operator 22 is released, the air returns to the switch air gap between the substrate 54 and the membrane 60 to break contact. Besides the measure of pre-travel, several other factors contribute to a sense of feel to the user when the switch 10 is operated. The return spring 35 extends a sufficient distance to provide a measure of over-travel for the switch operator 22, and the resilient pad 45 emulates, to some extent, the action of the user's fingertip.

Figure 5:
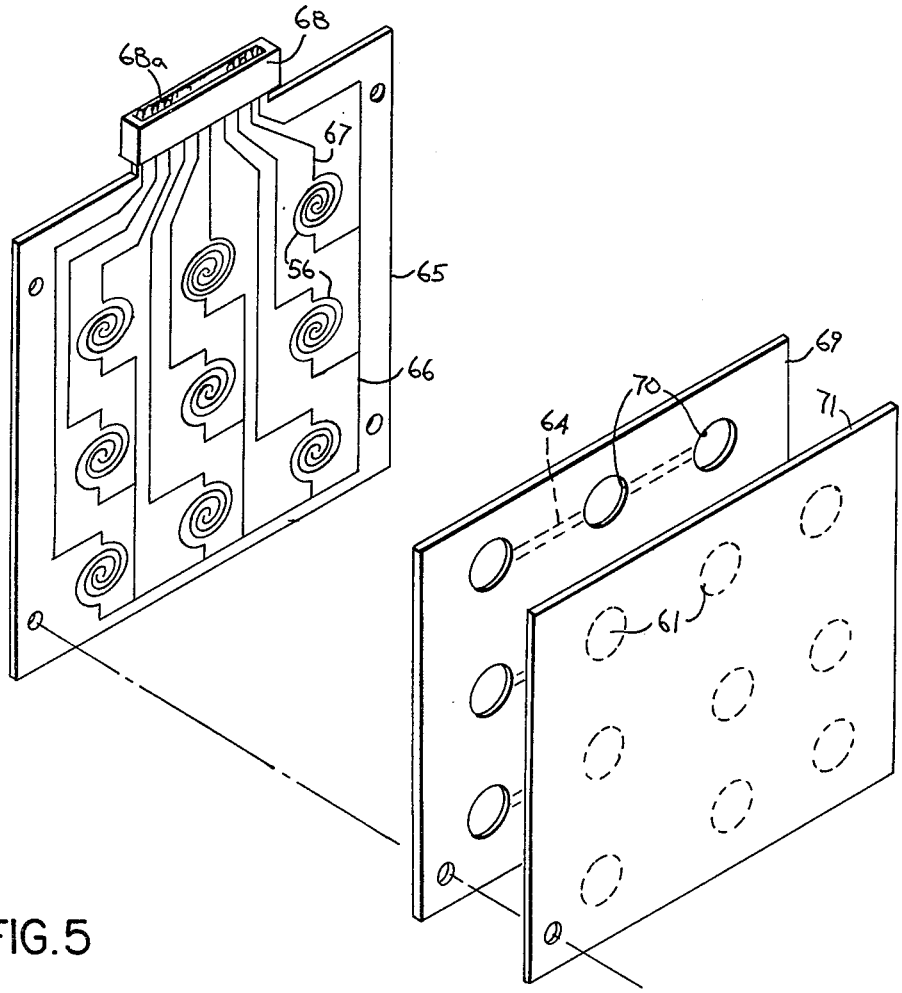
FIG. 5 is an exploded perspective view of a circuit board assembly seen in assembled form in FIG. 6.

As seen in a second embodiment in FIG. 5, the structure and method of making the contact assembly 14 is adapted to an array of contacts for a plurality of switches. A plurality of double spiral configurations 56 in a three-by-three, two-by-four, three-by-four, four-by-four, or other matrix configuration is etched in the manner described above on a circuit board 65 which serves as the substrate for the array. The pattern seen in FIG. 5 is a three-by-three common bus arrangement where one termination area 56 in each double spiral configuration is connected to a common ground circuit path 66 while the other contact termination area 56 in each spiral configuration has its own respective circuit path 67 leading to a terminal **68*a* in an edge connector 68 mounted on one edge of the circuit board 65. Besides a common bus configuration, other configurations are possible, such as a set of circuit paths connecting pairs of spiral switch termination areas 56 to binary coded I/O terminals in the edge connector 68. In those embodiments a termination strip (not shown) is used, in addition to the edge connector 68, to terminate some of the circuit paths. A spacing sheet 69 of five mils thickness with circular apertures 70 in a corresponding array is then adhesively mounted on the circuit board 65. This spacing sheet 69 has channels 64 connecting the apertures 70 in each row to provide a path for circulating air from an actuated switch to and from its neighbors. Next, a flat membrane overlay 71 of five mils thickness with shorting patches 61 formed in corresponding configuration is adhesively secured to the spacer 69 so that each shorting patch 61 will oppose a respective double spiral pair of contact termination areas 56**.

Figure 6:
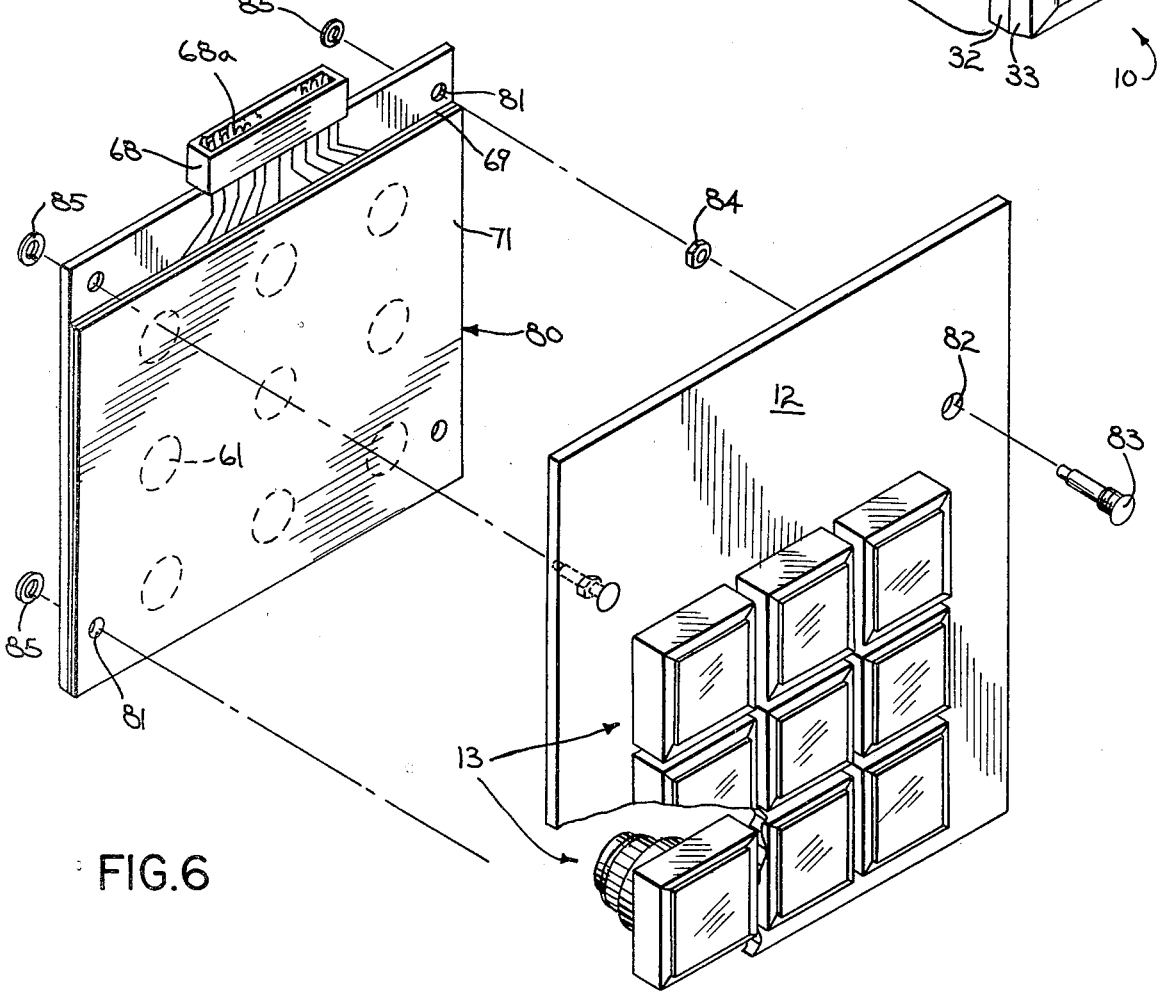
FIG. 6 is a partially exploded perspective view of an array of switch operator assemblies seen in FIG. 3, which are combined with the circuit board assembly of FIG. 5.

Referring to FIG. 6, the circuit board assembly 80 just described in assembled with a plurality of switch operator units 13, such as push buttons, pilot lights and lighted push button units that are mounted in a control panel 12 or other supporting structure. The latter two types of switch units are constructed according to the disclosure in a copending application of Fillus et al, entitled "Illuminated Industrial Membrane Switch", and filed concurrently herewith. To mount the switch operator units a plurality of circular apertures (one of which is seen in FIG. 2) are provided in the panel 12, with the switch operator unit 13 being positioned as seen in FIG. 2 with the back side of the rectangular portion 16 of the bezel 15 meeting the front side of the panel. As seen in both FIGS. 1 and 2, an annular gasket 76 of a synthetic elastomeric material and a metal washer 77 are slipped over the outside of the barrel 17 and held against the back side of the control panel by an annular lock ring 78 with an interior thread that engages a thread running around the circumference of the barrel 17. The outer surface of the lock ring 78 is knurled for a better grip.

With a plurality of operators assembled in the panel as seen in FIG. 6, the circuit board assembly 80 is attached. The circuit board 65 has holes 81 in its four corners which are aligned with corresponding countersunk holes 82 in the control panel 12. Circuit board standoffs 83 are inserted through the holes in the panel 12 and sealing lock nuts 84 are threadingly turned onto the standoffs 83 until positioned against a panel gasket 86 seen in FIG. 7 on the back side of the panel 12. External prong retainers 85 are attached to the ends of the standoffs 83, which extend through the aligned holes 81 in the circuit board assembly 80, these ends being specially adapted to receive such retainers 85.

Referring again to FIG. 7, one of the push buttons 10 in the assembled array is seen with its actuator pad 45 in registration with the shorting patch 61 on the overlay 71. The circuit board assembly 80 is mounted at a distance from the panel 12 where the exit ends of the bezels 15 abut the overlay 71 and complete the seal around the contact structure formed in the circuit board assembly 80.

It can be seen that the present invention provides a switch with a lower profile than prior switches used in a manufacturing environment, yet with the look and feel desired by industrial customers. The contact assembly 14 in the individual switch completes the sealed switch structure, and is easily removed if the conductive contact areas are accidentally damaged. The contact structure is easily produced in multiple units for use in control panel arrays.

While the foregoing description provides the details of making and using two embodiments of the invention, the full scope of embodiments contemplated by the invention is described by the following claims.

We claim:

1. An electrical switch which comprises:

an operator housing with a front end, a rear end and an opening therethrough from a housing entrance at the front end to a housing exit at the rear end;

an operator disposed in the opening in the operator housing, the operator extending from one end at the housing entrance to a distal end spaced inwardly from the housing exit, the operator being mounted for movement within the operator housing such that the distal end of the operator is movable toward the housing exit to actuate the switch;

a resilient pad mounted on the distal end of the operator;

a sealed-contact unit that extends across the exit of the housing and includes a substrate of insulating material, a pair of contact elements spaced apart in the direction of operator travel to provide a switch gap, the first contact element being supported by the substrate, a flexible membrane of insulating material on which the second contact element is disposed on its underside in a position opposite the conductive element on the substrate, spacing means disposed between and secured to the flexible membrane and the substrate for surrounding and sealing the contact elements within a contact chamber that is formed around the switch gap, wherein the contact unit further includes a contact housing that closes over the exit of the operator housing and has a cavity in which the substrate, the flexible membrane and the spacing means are disposed to enclose the contact elements within the contact housing; and wherein the switch is actuated through an initial movement of the operator towards the housing exit, and the further movement of the pad of resilient material against the membrane until the switch gap is closed.

2. The electrical switch of claim 1, further comprising a pair of elongated switch terminals attached to the substrate and electrically connected to the contact elements when the switch is actuated, the switch terminals extending from within the cavity of the contact housing to its exterior and having exterior portions that are adapted to be twisted to anchor the contact unit within the cavity of the contact housing.

3. The electrical switch of claim 1, wherein the flexible membrane is flat and together with the contact housing is positioned flush against the operator housing exit to provide a low profile contact unit.

4. An array of switches for installation in a control panel or other supporting structure, the array comprising:

a circuit board assembly including a circuit board with an array of pairs of contact termination areas, a flexible membrane disposed over the circuit board and carrying an array of shorting patches, each of which is disposed on an inner side of the flexible membrane in opposition to a corresponding pair of termination areas, spacing means between the circuit board and the flexible membrane enclosing each shorting patch and a respective pair of termination areas within a contact chamber in which a switch gap is provided between the shorting patch and the termination areas, and a plurality of switch terminals along an edge of the circuit board that are electrically connected through the circuit paths to the contact termination areas;

a plurality of operator assemblies adapted to be mounted in a control panel or other supporting structure that has an array of apertures spaced for one-to-one correspondence with the shorting patches on the circuit board, each operator assembly including an operator housing with a forward portion that is open at its front to provide a housing entrance and with a barrel portion that extends rearwardly from the forward portion and is open at its rear to provide a housing exit, the forward portion of the operator housing extending radially outward of the barrel portion to control the depth of insertion of the operator housing into the control panel or other supporting structure, a reciprocally movable, manually engageable operator slidably contained within and insertable into the housing, the operator having a head portion closing the entrance of the housing and a stem portion extending rearwardly from the head portion to a distal end of the operator, the operator being mounted for movement within the operator housing and the distal end of the operator being spaced from, and movable to, the housing exit, and a pad of resilient material mounted on the distal end of the operator to engage the membrane and close one of the switch gaps; and means for retaining each of the operator assemblies in an inserted portion in the control panel or other supporting structure with the barrel portion of each operator assembly extending to the same depth behind the control panel or other supporting structure as the barrel portions of the other operator assemblies in the array; and means for mounting the circuit board assembly behind the control panel or other supporting structure to abut the rear of the operator housings and close over the housing exits to form an array of sealed-contact switches.

5. The array of claim 4, wherein the operator housings each have a cylindrical barrel portion and a rectangular forward portion with a length and width that are each greater than the diameter of the cylindrical barrel portion.

* * * * *

UNITED STATES PATENT AND TRADEMARK OFFICE

CERTIFICATE OF CORRECTION

PATENT NO. : 4,376,239

DATED : March 8, 1983

INVENTOR(S) : Eric L. Long et al

It is certified that error appears in the above—identified patent and that said Letters Patent is hereby corrected as shown below:

Column 1, line 58 - "membranes" should be --membraneous--

Column 6, line 41 - "in" should be --is--

Column 8, line 60 - "portion" should be --position--

Signed and Sealed this

*Thirty-first* Day of *May 1983*

[SEAL]

*Attest:*

DONALD J. QUIGG

*Attesting Officer*

*Acting Commissioner of Patents and Trademarks*